United States Patent [19]

Suzuki

[11] 4,179,082

[45] Dec. 18, 1979

[54] BOBBIN HOLDER

[76] Inventor: Takeshi Suzuki, 19, Hacchodori, 4-chome, Toyohashi-shi, Aichi-ken, Japan

[21] Appl. No.: 891,181

[22] Filed: Mar. 29, 1978

[51] Int. Cl.[2] ..... B65H 54/54; B65H 54/74; B65H 79/00

[52] U.S. Cl. ..... 242/129.51; 242/18 DD; 242/19

[58] Field of Search ..... 242/18 DD, 129.51, 19, 242/48, 68.4; 308/149, 159, 174

[56] References Cited

U.S. PATENT DOCUMENTS

| | | | |
|---|---|---|---|
| 408,812 | 8/1889 | Pratt | 308/149 |
| 848,773 | 4/1907 | Schulz | 308/174 X |
| 849,274 | 4/1907 | Sheasby | 308/174 |
| 893,404 | 7/1908 | Washington | 308/174 |
| 1,067,860 | 7/1913 | Bradshaw | 308/159 |
| 2,404,084 | 7/1946 | Norton | 308/174 |
| 2,865,577 | 12/1958 | Furst | 242/129.51 |
| 3,610,714 | 10/1971 | DeGaeta | 308/174 X |
| 3,655,226 | 4/1972 | Cowan | 242/129.51 X |
| 3,765,736 | 10/1973 | Pitner | 308/174 |
| 4,013,242 | 3/1977 | Burysek et al. | 242/129.51 |

*Primary Examiner*—Stanley N. Gilreath
*Attorney, Agent, or Firm*—Burgess, Ryan and Wayne

[57] ABSTRACT

A bobbin holder of a winder wherein a shaft carrying a bobbin holding disk or projection is supported in a bushing by needle or ball bearings which carry the radial load, and the lower end of the shaft is supported by a thrust receiving plate which in turn is supported by a thrust receiving ball disposed for rotation at the bottom of the bushing and for carrying the thrust load. Alternatively, the lower end of the shaft is terminated in the form of a truncated cone and is supported by more than three balls which carry both the radial and thrust loads. A flanged seal and a seal ring are mounted on the upper outside of the bushing to prevent the intrusion of cotton fibers and dust into a bearing chamber of the bushing.

5 Claims, 3 Drawing Figures

BOBBIN HOLDER

BACKGROUND OF THE INVENTION

The present invention relates to a bobbin holder of a winder.

In FIG. 1 there is shown a prior art bobbin holder comprising a bobbin holding disk 1 (mainly for a cone bobbin) or projection (mainly for a parallel bobbin), a rotary shaft 2, balls 3 and 4, an outer race 5 and a bushing 6. The rotary shaft 2 is pressed and fitted into a hole in the bobbin holder 1 or otherwise formed integral therewith, and the balls 3 make up a deep-groove ball bearing so that the thrust load may be taken by it to some extent, but it cannot carry heavy thrust loads. Furthermore because of the limited space, the balls 3 and 4 with only a small diameter are used. The yarn is taken around the bobbin at a constant peripheral speed so that the rotational speed of the bobbin holder is as high as 3,000 r.p.m. when the spinning is started and the weight of yarn taken on the bobbin is as heavy as 1.5 kilograms at the end of the winding. These loads are concentrated on the bearings so that the bearings are subjected to severe wear and abrasion and consequently their service life is very short. Moreover, a three-stepped bore consisting of a small-diameter bore portion 6*a* for receiving therein the lower end portion of the shaft 2, an intermediate-diameter portion 6*b* for receiving the outer race 5 and a large-diameter portion 6*c* for receiving therein a boss 1' of the bobbin holding plate 1 must be bored or otherwise formed in the bushing 6, and the dimensions of these bore portions are limited. Because of these complex configurations, a large number of steps is required for the fabrication of the bushing 6.

SUMMARY OF THE INVENTION

The present invention therefore has for its object to provide a bobbin holder which is free from variations in rotational speed even under thrust loads and which is simple in construction so that the number of fabrication steps may be minimized.

BRIEF DESCRIPTION OF THE DRAWINGS

Same reference numerals are used to designate similar parts in FIGS. 2 and 3.

DESCRIPTION OF THE PREFERRED EMBODIMENTS

Figure 1:
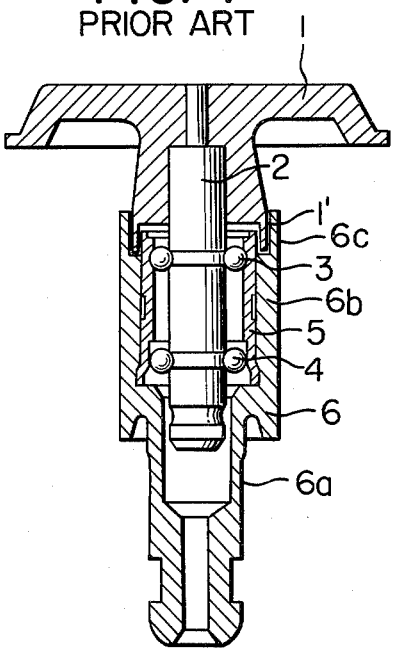
FIG. 1 PRIOR ART
FIG. 1 is a longitudinal sectional view of a prior art bobbin holder.
Figure 2:
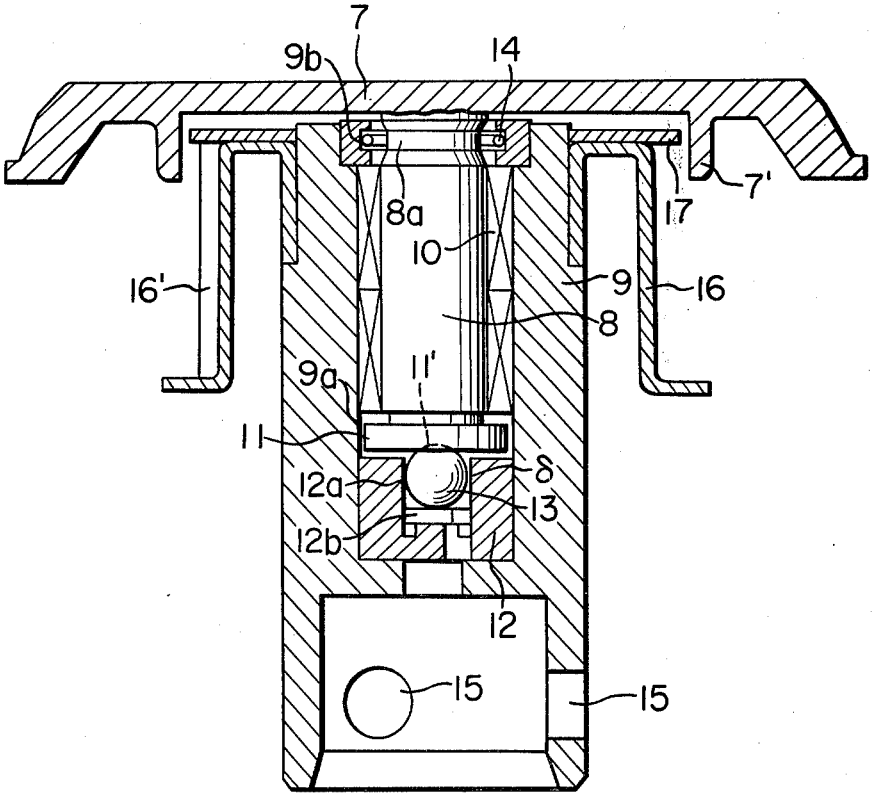
FIGS. 2 and 3 are longitudinal sectional view of bobbin holders in accordance with the present invention.

First Embodiment, FIG. 2

In FIG. 2 there is shown a first embodiment of the present invention having a rotary shaft 8 pressed and fitted into a bobbin holding disk or projection 7 or otherwise formed integral therewith. The rotary shaft 8 is supported by needle or ball bearings 10 which are fitted into a bore 9*a* of a bushing 9 and carry the radial loads from the rotary shaft 8. The lower end of the rotary shaft 8 contacts a thrust receiving plate 11 which in turn contacts a ball 13 received in a bore of a housing 12 fitted at the bottom of the bore 9*a*. The inner diameter of the housing 12 is greater than the outer diameter of the ball 13 by a very small amount $\delta$ so that the ball 13 contacts the bore wall at a point 12*a*, with the bottom of the bore at 12*b* and with a recess 11' of the thrust receiving plate 11. When the rotary shaft 8 is rotated, the ball 13 is rotated and carries the thrust loads. As the thrust receiving plate 11 has the recess 11', the edge of the thrust receiving plate 11 may not contact the inner wall of the bushing 9. The thrust receiving plate 11 is made of steel or synthetic resin. If made of synthetic resin, the thrust receiving plate 11 is simply fabricated, its load capacity is large and its life is long.

In order to prevent the rotary shaft 8 from being pulled off from the bushing 9, a split elliptical spring 14 is fitted into grooves 9*b* formed in the bore wall of the bushing 9 in such a way that the portions close to the intersection of the minor axis with the elliptical spring are inserted into an annular groove 8*a* of the rotary shaft 8. This groove 8*a* is sufficiently wide and deep so that the contact of the elliptical spring 14 with the rotary shaft 8 is normally prevented. Therefore while the elliptical spring 14 prevents the shaft 8 from being pulled off from the bushing 9, it will not adversely affect the rotation of the shaft 8. Since the split spring 14 is opened the rotary shaft 8 may be easily pulled out of the bushing 9 for lubrication purpose and then easily inserted again. The bushing 9 has holes 15 with which the bobbin holder is attached to a winder. A protecting flange 16, the outside end of which is stretched, has a plurality of protrusions 16' and a seal ring 17 is mounted on the upper surface of the protecting flange 16.

The bobbin holder constructed as above does not produce variations in rotational speed as seen in the prior art, because the thrust load acting on the disk 7 is taken by the ball 13. The plurality of protrusions 16' of the protecting flange 16 are used for cutting and undoing a yarn wound around the protecting flange 16. The protecting flange 16 and the seal ring 17 positively prevent the intrusion of cotton and dust into the bearing chamber of the bushing 9. The protrusive ring 7' of the disk 7 may prevent the leakage of machine oil which might flow from the bearing portion through the under surface of the disk 7 to the outside of the bushing 9 and stain the yarn.

Figure 3:
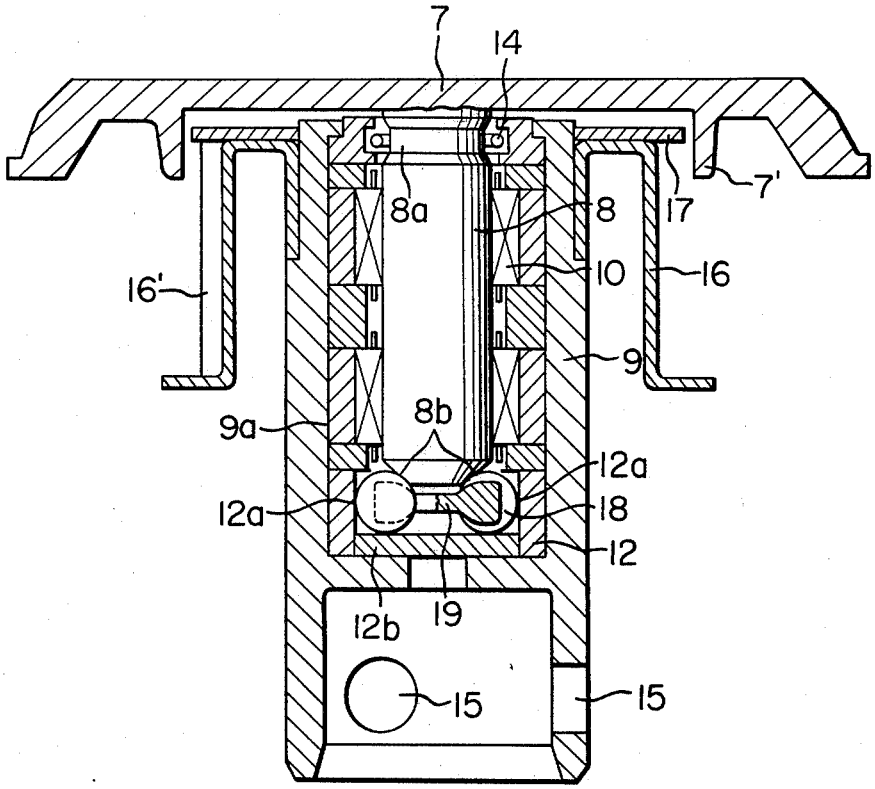

Second Embodiment, FIG. 3

In FIG. 3 there is shown a second embodiment of the present invention. The lower end of the rotary shaft 8 is terminated into a truncated cone 8*b* so as to carry both the thrust and radial loads. The truncated cone or conical surface 8*b* is supported by more than three balls 18 in the housing 12. Therefore the balls 18 contact the truncated conical surface 8*b* at the lower end of the shaft 8, the bore wall 12*a* and the bottom 12*b* of the housing 12, and are retained by a ball retainer 19 made of a plastic so that they may be spaced apart from each other by a suitable distance.

Each of the balls 18 contact a point on the bore wall, a point on the bottom and a point on the truncated conical surface of the shaft 8 as described above. Furthermore the radii of the balls 18 are perpendicular to these surfaces of contact, and balls 18 with a large diameter may be used. As a result, they may carry heavy loads and may have a long service life. Since the truncated conical surface 8*b* is supported by more than three balls 18, self-alignment of the axis of the rotary shaft 8 with the axis of the bushing 9 is attained when a thrust load acts on the shaft 8.

As described above, according to the present invention even under the heavy thrust load, the variations in rotational speed may be eliminated. Since both the shaft and the bushing are very simple in construction, the fabrication thereof is very easy. Furthermore, balls 18, with a large diameter, may be used. Moreover, since each of the balls 18 makes a three-point contact as described above, the balls 18 may carry the loads while rotating. Therefore, the balls 18 may carry heavy loads, and the bobbin holder may have a long service life. Thus, the present invention provides a very advantageous bobbin holder.

What is claimed is:

1. A bobbin holder, comprising:

a bushing having an interior cavity with a cylindrical wall adjacent one end thereof;

a shaft disposed in said cavity with a free end of said shaft extending from said end of said bushing and the other end of said shaft adjacent an interior supporting surface within said cavity;

bearing means disposed between the peripheral surface of said shaft and the cylindrical wall of said cavity;

means for securing a bobbin holder to said free end of said shaft;

a thrust receiving ball disposed in contact with said interior supporting surface;

a thrust receiving plate disposed between said ball and said other end of said shaft; and a peripheral protective flange secured to said bushing adjacent said one end thereof, said flange having a plurality of protrusions for cutting and undoing any yarn which may become wound around said flange.

2. A bobbin holder, comprising:

a bushing having an interior cavity with a cylindrical wall adjacent one end thereof;

a shaft disposed in said cavity with a free end of said shaft extending from said end of said bushing and the other end of said shaft adjacent an interior supporting surface within said cavity;

bearing means disposed between the peripheral surface of said shaft and the cylindrical wall of said cavity;

means for securing a bobbin to said free end of said shaft;

said other end of said shaft having a truncated conical surface;

more than three thrust receiving balls disposed between said interior supporting surface and the conical portion of said truncated conical surface; and a peripheral protective flange secured to said bushing adjacent said one end thereof, said flange having a plurality of protrusions for cutting and undoing any yarn which may become wound around said flange.

3. A bobbin holder, comprising:

a bushing having a bore therein, said bore having a bottom and an open end remote from said bottom;

a shaft disposed in said bore and having a free end extending from the open end of said bore;

a member for holding a bobbin connected to the free end of said shaft;

needle or ball bearings for rotatably supporting said shaft in said bushing;

a thrust receiving plate adjacent the bottom of said bore for receiving thrust from said shaft;

a thrust receiving ball disposed at the bottom of said bore for supporting said thrust receiving plate, a gap being provided between the wall of said bore and said thrust receiving ball whereby the thrust load acting on said shaft may be taken by said thrust receiving plate and ball and said ball may roll smoothly;

a protecting flange mounted on said bushing adjacent the free end of said shaft, said flange having a plurality of protrusions for cutting and undoing a yarn wound around said protecting flange; and a seal ring mounted on said protecting flange and a protruding ring provided on the surface of said bobbin holding member adjacent the free end of said shaft, thereby preventing intrusion of cotton and dust and leakage of machine oil under the member on the opposite side of said seal ring.

4. A bobbin holder, comprising:

a bushing having a bore therein, said bore having a bottom and an open end remote from said bottom;

a shaft disposed in said bore, said shaft having a free end extending from the open end of said bore and a truncated conical surface at the other end of said shaft adjacent the bottom of said bore;

a member for holding a bobbin connected to the free end of said shaft;

needle or ball bearings for rotatably supporting said shaft in said bushing;

more than three thrust receiving balls disposed at the bottom of said bore for supporting said truncated conical end surface of said shaft; and a protecting flange mounted on said bushing adjacent the free end of said shaft having a plurality of protrusions for cutting and undoing a yarn wound around said protecting flange.

5. A bobbin holder as set forth in claim 4, further comprising a seal ring mounted on said protecting flange and a protruding ring provided on the lower surface of said member, thereby preventing intrusion of cotton and dust and leakage of machine oil under the member on the opposite side of said seal ring.

* * * * *